US005966960A

United States Patent [19]

Cummings et al.

[11] Patent Number: 5,966,960

[45] Date of Patent: Oct. 19, 1999

[54] BI-DIRECTIONAL REFRIGERANT EXPANSION VALVE

[75] Inventors: Larry Donald Cummings, Clarence; Taylor R. Eckstein, Jr., N. Tonawanda, both of N.Y.

[73] Assignee: General Motors Corporation, Detroit, Mich.

[21] Appl. No.: 09/106,197

[22] Filed: Jun. 26, 1998

[51] Int. Cl.[6] ..... F25B 41/06

[52] U.S. Cl. ..... 62/296; 62/511; 138/44

[58] Field of Search ..... 62/296, 511, 527; 138/41, 44; 181/196, 210

[56] References Cited

U.S. PATENT DOCUMENTS

| | | | |
|---|---|---|---|
| 2,936,790 | 5/1960 | Dahl et al. | 62/511 |
| 3,677,300 | 7/1972 | King | 138/42 |
| 3,820,571 | 6/1974 | Grier | 138/44 |
| 3,823,743 | 7/1974 | King | 138/42 |
| 4,150,696 | 4/1979 | Meier et al. | 138/44 |
| 4,408,467 | 10/1983 | Murnane et al. | 62/296 |
| 4,426,213 | 1/1984 | Stavropoulos | 55/466 |
| 4,793,150 | 12/1988 | Wattley et al. | 62/296 |
| 5,036,948 | 8/1991 | Henn | 181/258 |
| 5,893,273 | 4/1999 | Casiraghi | 62/511 |

*Primary Examiner*—William E. Tapolcai
*Attorney, Agent, or Firm*—Patrick M. Griffin

[57] ABSTRACT

An automotive air conditioning system orifice tube type refrigerant expansion valve is axially symmetrical, so as to be error proof at installation, and/or so as to operate in a bi directional refrigerant flow. A pair of coaxial screens surrounding each end of the orifice tube, an inner noise attenuation screen of finer mesh, and an outer particulate screen of coarser mesh, provide upstream particulate exclusion and downstream noise attenuation without the potential for reverse installation. In addition, by pass ports allow for a by pass flow should the downstream inner screen become plugged.

3 Claims, 4 Drawing Sheets

A SYMMETRICAL ORAFICE TUBE
B STANDARD OT (NORMAL FLOW)
C STANDARD OT (REVERSE FLOW)

BI-DIRECTIONAL REFRIGERANT EXPANSION VALVE

TECHNICAL FIELD

This invention relates to automotive air conditioning system refrigerant expansion valves in general, and specifically to such an expansion valve that uses a fixed orifice tube, which is symmetrical, bi directional, and which has provision for particulate filtering, noise attenuation, and by pass flow in the event of filter blockage.

BACKGROUND OF THE INVENTION

Automotive air conditioning systems incorporate a refrigerant expansion valve in the refrigerant line that runs from the condenser to the evaporator, in order to render the pressurized refrigerant suitable for use in the evaporator. Basically, the refrigerant is run through a reduced diameter orifice, causing it to rapidly contract and then expand on the other side, into a low pressure, cold mist. More expensive systems use a selectively expandable and contractible orifice, but a fixed orifice tube, generally brass, is still commonly used, because of its inexpensive and reliable operation. The orifice tube is typically centered within a support plug, which is then crimped inside the refrigerant line to center the tube within the line. The refrigerant leaving and expanding from the downstream end of the tube produces expansion noise, especially evident as a hissing noise at system shut down. Another consideration with expansion valves is the necessity to filter out particulates carried by the refrigerant at the upstream end of the tube.

Conventional orifice tube assemblies deal with upstream particulate filtering and downstream noise attenuation through the use of two different purpose screens, one surrounding each opposed end of the tube. At the upstream end, a relatively large mesh, long and large diameter particulate screen, typically nylon screen, provides enough surface area to catch particulates without totally plugging over a suitable operation interval. At the downstream end, a relatively small mesh, shorter and smaller diameter screen muffles expansion noise, by acting as a baffle to reduce turbulence. Such an assembly, being asymmetrical, is not intended to work in each direction, or to be installed in either direction within the refrigerant line. However, it is possible to accidentally install it backward. If this occurs, the orifice tube per se can perform its task in either direction. Furthermore, the noise attenuation screen, if misplaced upstream, can provide particulate exclusion, albeit for a shorter interval before it would need to be changed, given its smaller total surface area. However, the particulate filter, if misplaced downstream, does not, by its nature, provide adequate noise attenuation, given its larger size, and particularly its larger mesh. Backward assembly will, therefore, be made evident by increased noise of operation, but even if the cause of the noise is properly analyzed, it is inconvenient to have to remove and re install the valve.

SUMMARY OF THE INVENTION

The invention provides an orifice tube type refrigerant expansion valve which can be installed in, and which will operate in, either direction, while providing adequate particulate filtration and even improved noise attenuation. Provision is also made for a by pass flow out of and around the downstream noise attenuation screen should it become plugged over time.

In the preferred embodiment disclosed, a constant diameter orifice tube is centered within the refrigerant line within a sealed central plug. The entire valve assembly, as a structure, is symmetrical about the center plane of the plug, and therefore insensitive to installation direction. Each end of the tube is surrounded by a double screen, an outer, longer, coarser meshed screen, and concentric inner, shorter, finer meshed screen. The upstream, outer screen provides initial particulate exclusion, while the downstream outer screen although redundant to particulate filtering, but does not retard refrigerant flow appreciably. The downstream, inner screen is sufficiently finely meshed, and extends sufficiently beyond the downstream end of the orifice tube, to provide expansion noise attenuation. The upstream, inner screen does serve to dampen any noise produced at the upstream end of the orifice tube.

Each inner screen held in a rigid support frame that maintains a radial space around each end of the orifice tube, and which abuts to the central plug. An annular end ring of each inner screen support frame has at least one by pass port, which is located axially inboard from the end of the orifice tube. Should the downstream inner screen, which is finer meshed, plug with particulates that have passed both upstream screens, then the refrigerant flow can turn axially back upstream through the radial space, to and through the by pass ports, and then on out through the downstream outer screen.

BRIEF DESCRIPTION OF THE DRAWINGS

These and other features of the invention will appear from the following written description, and from the drawings, in which.

DESCRIPTION OF THE PREFERRED EMBODIMENT

Figure 1:
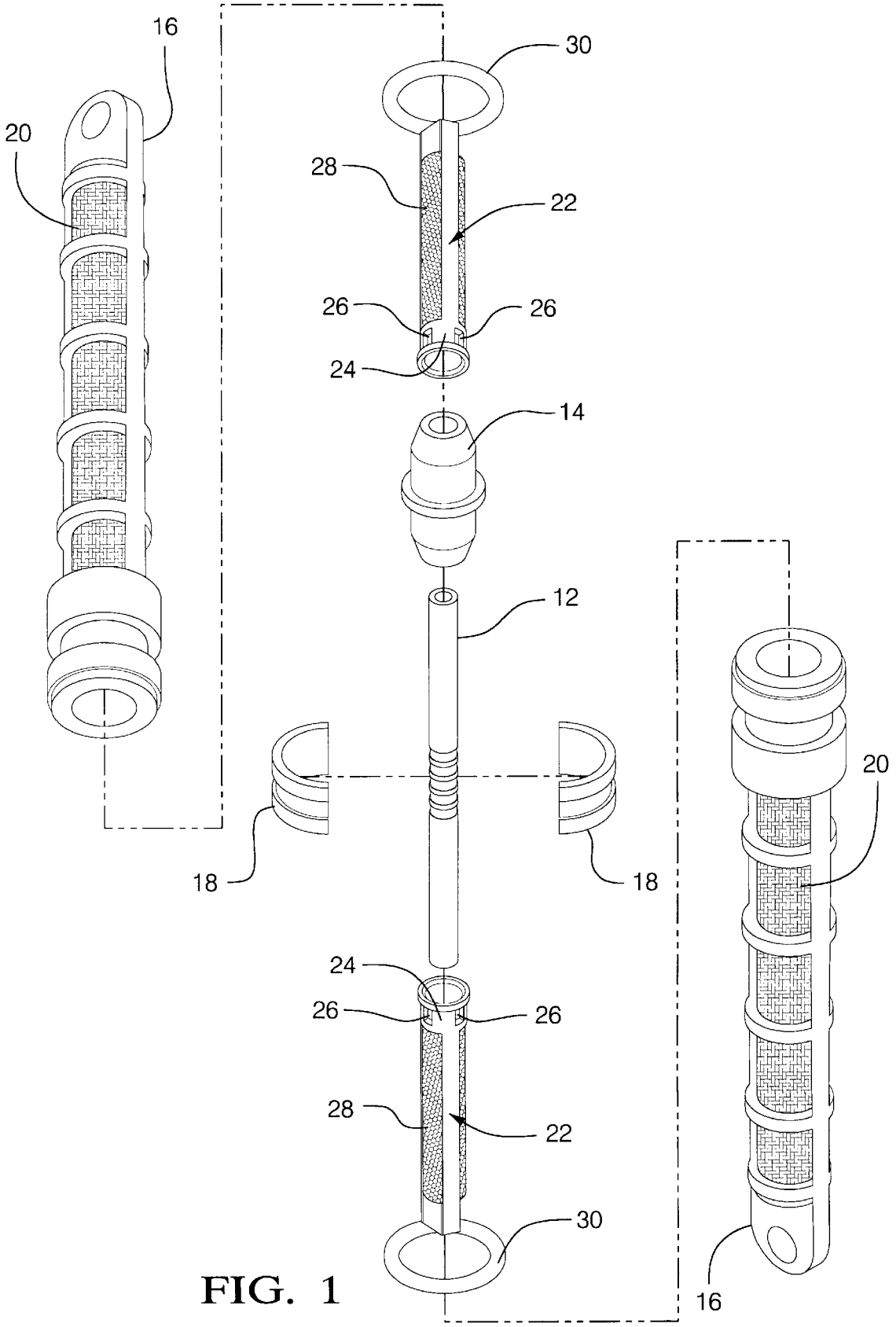
FIG. 1 is an exploded perspective view of a preferred embodiment of an expansion valve according to the invention.
Figure 2:
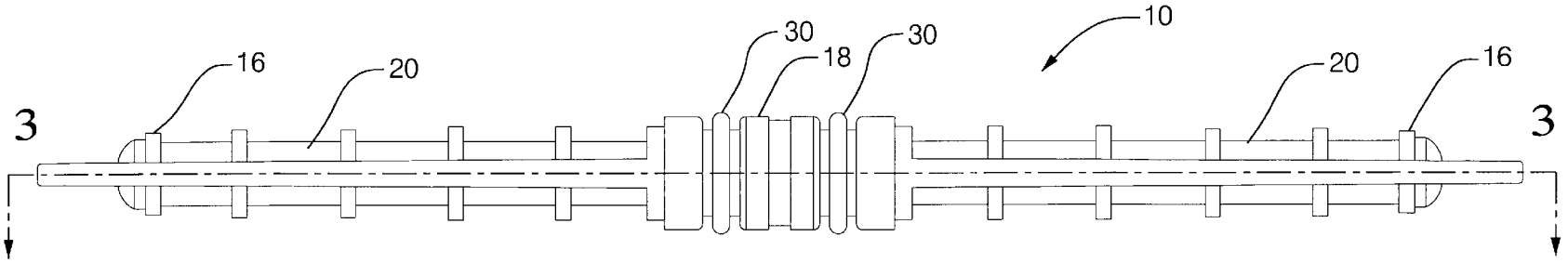
FIG. 2 is a side view of the assembled valve.

Referring first to FIGS. 1 and 2, a preferred embodiment of a valve made according to the invention is indicated generally at 10, shown both complete and separated into its component parts. The central operative structure of valve 10 is a length of brass orifice tube 12, approximately twenty five mm long and one and a half mm in inside diameter. Orifice tube 12 is molded symmetrically, coaxially and gas tight within a plug 14, which is approximately seven mm in outside diameter and approximately twelve mm long. Because of its symmetry, either end of tube 12 can serve as the inlet or outlet end, and that symmetry is carried across the rest of valve 10, as well. An identical pair of rigid molded plastic, axially and radially ribbed exterior support frames 16 provide the main framework. Each frame 16 is approximately sixty mm long and ten mm in outside diameter at the end, and has an inside diameter that fits tightly over either end of the plug 14. A band mold 18 is ultimately formed over the ends of the exterior frames 16 to fix them securely to the plug 14. The inside of each exterior frame 16 supports a generally cylindrical, comparable length particulate screen 20, with a closed outer end and an open inner end that is molded into the inside of the end of frame 16. Exterior screen 20 is nylon mesh, with a 275 micron mesh size, comparable to current screens. An identical pair of rigid molded plastic, axially ribbed interior support frames, indicated generally at 22, each fits over an end of tube 12 and within an end of outer screen 20. Specifically, interior support frame 22 is approximately twenty four mm long, with an inner diameter slightly larger than orifice tube 12 and with an annular end ring 24, comparable in diameter to plug 14, which inserts snugly into the end of an exterior support frame 16. Just in front of end ring 24 are four evenly spaced by pass ports 26. Supported within interior frame 22 is a generally an inner noise filter screen 28, which is a nylon screen of approximately 130 micron mesh size, considerably smaller than outer screen 20. Noise filter 28 is also generally cylindrical, with a closed outer end and an open inner end sealed to the inside of frame 22, but clear of the by pass ports 26. Finally, spaced O rings 30 bordering the band mold 18 are added to complete the valve 10.

Figure 3:
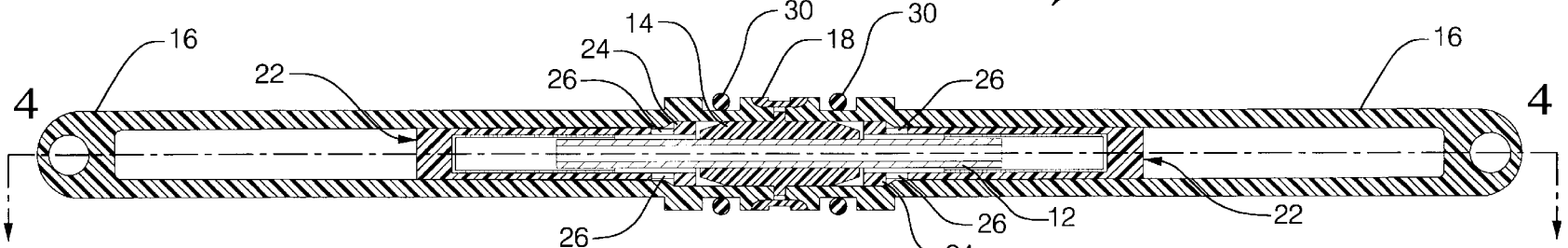
FIG. 3 is a cross section taken along the line 3—3 of FIG. 2.
Figure 4:
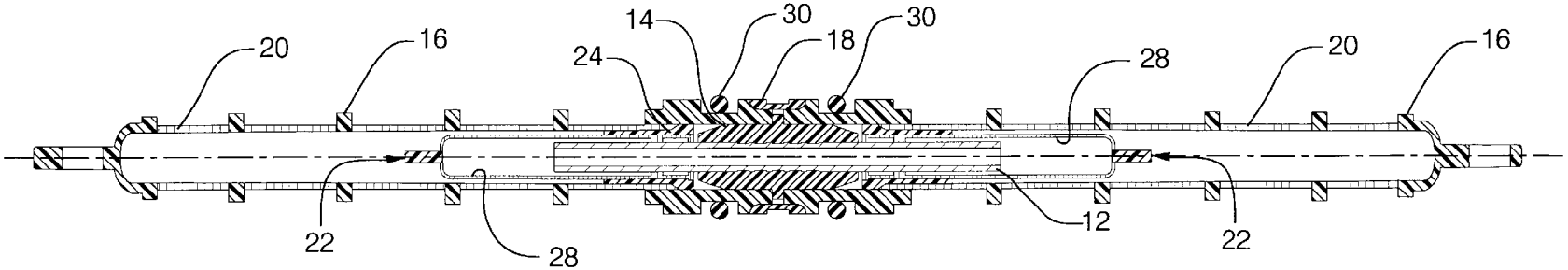
FIG. 4 is a cross section taken along the line 4—4 of FIG. 3.

Referring next to FIGS. 3 and 4, the inter relationship of the components in the assembled valve 10 is illustrated. Moving from the inside out, each end of the orifice tube 12 has about a nine mm set back from the closed end of the surrounding noise filter 28. The interior support frame 22, specifically the annular end ring 24 thereof, maintains both an open inner radial space relative to the outside of the orifice tube 12, and an open outer radial space relative to the inside of the exterior particulate screen 20, as best seen in FIG. 4. The ports 26 open across and connect these two open radial spaces. The interior support frame end ring 24 is substantially abutted to the plug 14, and the plug 14 blocks any possible flow except through the tube 12.

Figure 5:
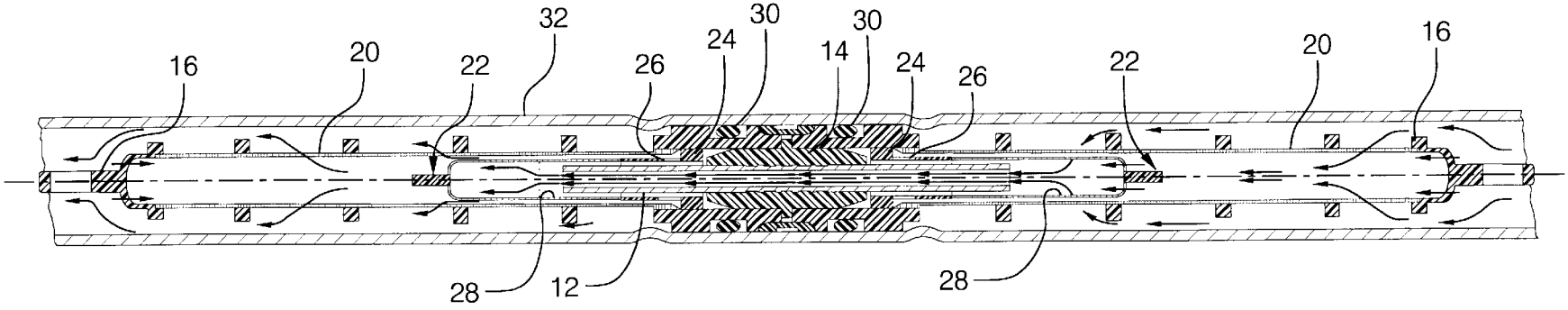
FIG. 5 is a view showing normal, unobstructed refrigerant flow.

Referring next to FIG. 5, the normal, post installation operation of valve 10 is illustrated. Valve 10 is inserted closely into the interior of a standard refrigerant line 32, typically aluminum, which is crimped down over the exterior support frames 16 to either side of the O rings 30, establishing a gas tight seal. Pressurized refrigerant flowing from right to left (from the condenser toward the evaporator) is blocked by the O rings 30 and by the plug 14, and forced to flow radially inwardly through the upstream outer screen 20. This blocks out most particulates. Next, the flow is forced radially inwardly through the upstream noise filter screen 28. The inner screen 28 is not necessary as a particulate filter, although it would incidentally serve to exclude smaller particulates. Some flow could, and likely would, also pass radially through the upstream by pass ports 26. However, this would not be a problem, as far as particulate pass through, because the upstream particulate filter screen 20 would already have acted. The majority of flow, however, will pass directly through the inner screen 28. While not needed as a particulate filter, the upstream inner screen 28 would serve to baffle any dampen noise occurring at the upstream end of tube 12. Having passed the upstream inner screen 28, refrigerant enters the upstream end of tube 12, where it is accelerated, and then exits the downstream end, where it is expanded into the lower pressure cold mist that is operative in the evaporator. From the exit end of tube 12, the velocity of the refrigerant flow is such as to carry it downstream and then radially out through the downstream noise filter screen 28. While flow would be theoretically possible through the downstream by pass ports 26, as well, the same considerations that prevent significant flow through the upstream by pass ports 26 apply, in addition to the significant velocity of the exit flow. Consequently, there is not normally a significant volume of by pass flow. The fine mesh of the downstream inner noise screen 28, in conjunction with the axial spacing of its closed end from the exit end of the tube 12, act to muffle and dampen expansion noise, without retarding flow significantly. The axial spacing of the end of the downstream inner screen 28 from the downstream end of tube 12 is thought to be important to the noise reduction achieved in any particular system, and would likely vary from system to system, or even over a range within a given system. For example, while a nine mm axial spacing is disclosed, a range of approximately five to nine mm. should be effective. Finally, refrigerant flows radially out through the redundant downstream particulate filter screen 20 and axially on through line 32 to the evaporator.

Figure 6:
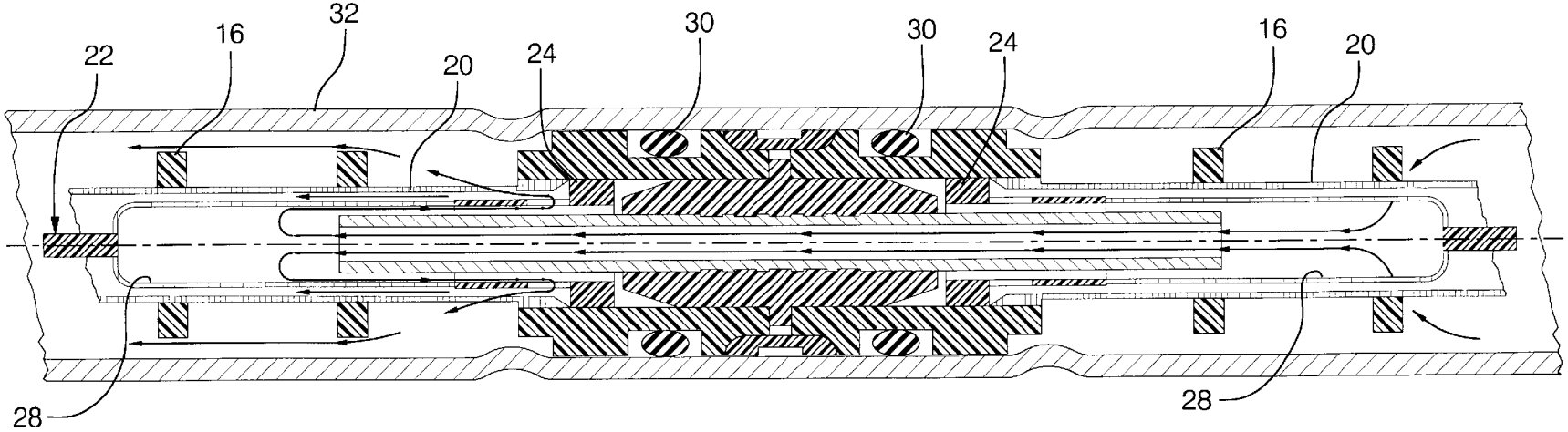
FIG. 6 is a view showing obstructed, by passed flow.

Referring next to FIG. 6, the downstream noise filter screen 28, while not needed as a particulate screen, can catch particulates on its inner surface, at least to the extent that any particulates larger than its mesh size have escaped both upstream screens 20 and 28. Over time, those could conceivably create a blockage. In that case, flow can turn back upstream from the exit end of tube 12, through the open radially inner space between inner screen 28 and the outside of tube 12, radially through the by pass ports 26, and then radially out through the downstream outer screen 20. The refrigerant flow rate would already be retarded at this point, but not completely blocked, because of the by pass ports 26. This would be evident as reduced system performance (although not by a complete shut off) which would signal an inspection of the system and a replacement of the valve 10.

Figure 7:
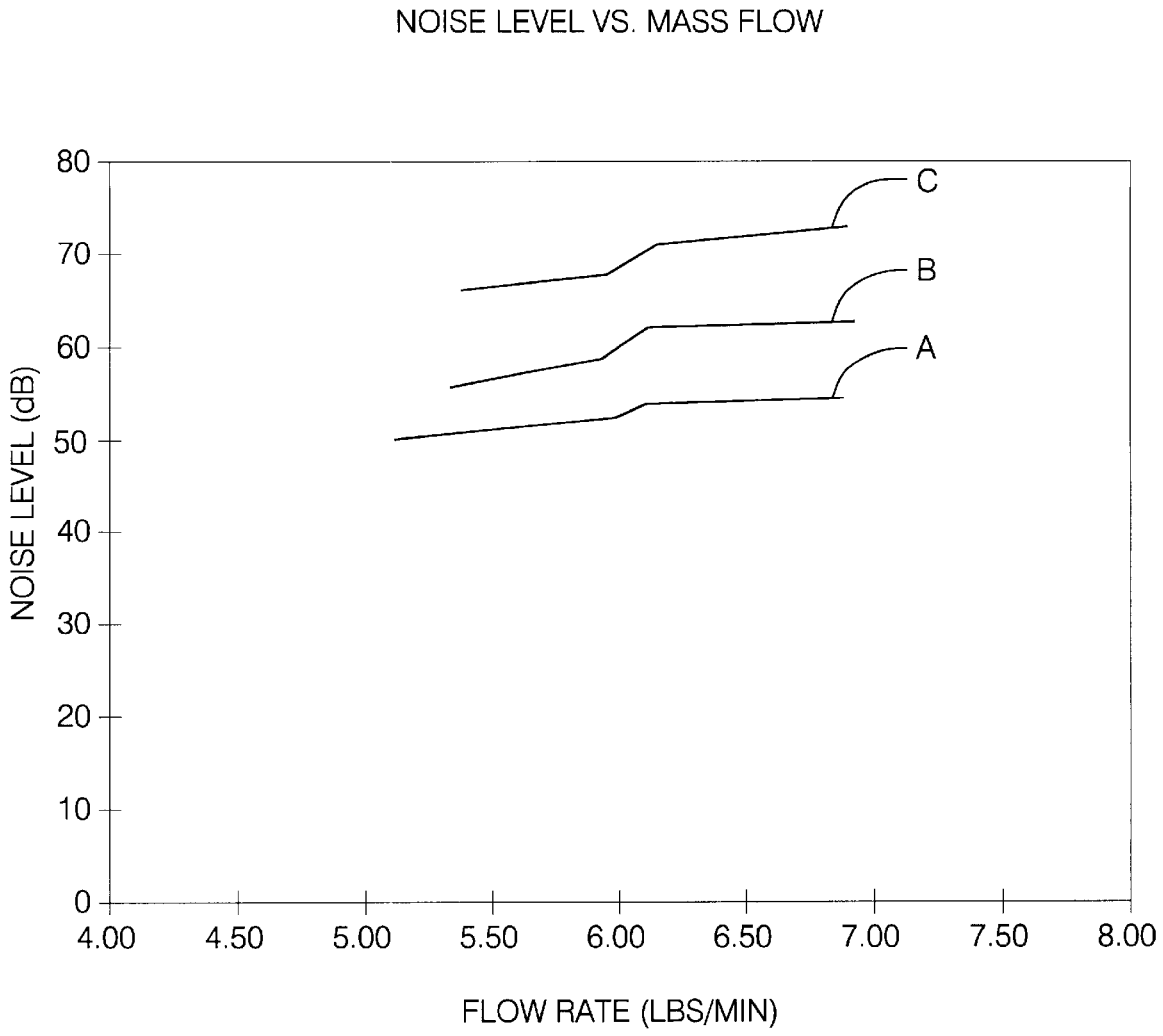
FIG. 7 is a graph comparing tested noise levels of a standard valve properly installed, a standard valve installed backward, and a preferred embodiment of a valve according to the invention, installed in either direction.

Referring next to FIG. 7, it will be appreciated, given the complete symmetry of valve 10 about the central plane of plug 14, that valve 10 could be installed in either direction with no effect. This is shown graphically in the plot of noise level versus mass flow rate. The invention operates at a lower noise level, regardless of installation orientation. Valve 10 would also work equally well with a refrigerant flow rate in either direction, as a heat pump provides. A conventional, non symmetrical valve, by contrast, operates at a significantly higher noise level when installed in a reverse orientation. Somewhat surprisingly, conventional, non symmetrical valve operates at a slightly higher noise level than valve 10, even when properly installed. This in spite of the expectation that the extra upstream noise filter screen 28 in valve 10, as well as the extra downstream particulate filter screen 20, would be substantially operationally redundant, apart from providing error proof installation. However, it appears that one or the other, or both, of the extra screens are providing some extra noise reduction.

Modifications could be made in the embodiment disclosed. If a suitably stiff screens 20 and or 28 could be provided, they could be self supporting, with no need for extra supporting frames 16 and 22. For example, thicker screens formed of stiff foam materials, while radially thicker, could take the place of the frames. However, the inner frame 22, and especially its annular end ring 24, are particularly useful for maintaining the inner radial spacing of the downstream inner screen 28 from the outside of the orifice tube 12. That inner radial spacing in turn, is important to provide the flow path out to the downstream by pass ports 26. The outer radial space between the two downstream screens 28 and 20 is not as critical to the by pass flow, though it provides more space for it. However, it may well be that the radial space between the two downstream screens 28 and 20 maintained by the annular end ring 24 has some beneficial effect on the noise muffling from the orifice tube's exit end, as noted above. The downstream interior frame 22 is also convenient for providing the downstream by pass ports 26, although they could potentially be provided directly in a very stiff inner screen 28. The by pass ports 26 would not be needed at all just to provide the basic features of improved noise muffling and direction insensitive installation, of course, but do provide a very convenient fail safe against downstream screen plugging. Therefore, it will be understood that it is not intended to limit the invention to just the embodiment disclosed.

We claim:

1. For use in a refrigerant line in an automotive air conditioning system in which the refrigerant carries particulate type contaminants, a bi directional refrigerant expansion valve with combined inlet particulate filter and valve outlet noise attenuation features, comprising:

a central, cylindrical orifice tube to receive and contract high pressure refrigerant inlet flow and expand it into a low pressure outlet flow, thereby creating expansion noise;

a substantially rigid central plug body adapted to be installed tightly sealed within the interior of said refrigerant line and also tightly sealed around the outside of said orifice tube with each end of said tube extending axially therefrom by the same distance, so that either end of said tube can provide an inlet and the other end an outlet, a pair of substantially rigid, outer particulate screens extending axially beyond each end of said orifice tube, each outer screen having a mesh just sufficiently small to exclude substantially all refrigerant particulates and surrounding each end of said orifice tube so that refrigerant must pass through a particulate screen before entering either end of the orifice tube, a pair of substantially rigid, inner noise filters sized to fit coaxially within said particulate screens, one surrounding each end of said orifice tube and having a porosity sufficiently small and an axial length sufficiently large to substantially muffle said refrigerant expansion noise as said refrigeration outlet flow runs through it from either end of said orifice tube, whereby flowing refrigerant is sequentially particulate filtered and noise muffled, regardless of the orientation of said valve within the refrigerant line.

2. For use in a refrigerant line in an automotive air conditioning system in which the refrigerant carries particulate type contaminants, a bi directional refrigerant expansion valve with combined inlet particulate filter and valve outlet noise attenuation features, comprising:

a central, cylindrical orifice tube to receive and contract high pressure refrigerant inlet flow and expand it into a low pressure outlet flow, thereby creating expansion noise;

a substantially rigid central plug body adapted to be installed tightly sealed within the interior of said refrigerant line and also tightly sealed around the outside of said orifice tube with each end of said tube extending axially therefrom by the same distance, so that either end of said tube can provide an inlet and the other end an outlet, a pair of substantially rigid, open exterior support frames sized to fit within said refrigerant line, one abutted to each end of said plug and extending axially beyond and surrounding each end of said orifice tube, an outer particulate screen having a mesh just sufficiently small to exclude substantially all refrigerant particulates and closely contained within each support frame and also having a closed outer end and an inner end effectively sealed to an end of said plug body, so that refrigerant must pass through a particulate screen before entering either end of the orifice tube, thereby excluding particulates, a pair of substantially rigid, open inner support frames sized to fit coaxially within said particulate screens, one surrounding each end of said orifice tube with an inner radial space between said inner frame and orifice tube and outer radial space between said inner frame and outer particulate screen, an inner noise filter closely contained within each of said inner support frames having a porosity sufficiently small and an axial length sufficiently large to substantially muffle said refrigerant expansion noise as said refrigeration outlet flow runs through it, and further having a closed outer end and an inner end effectively sealed to an annular end ring of said inner support frame, so that refrigerant exiting either end of said orifice tube will pass through the noise filter, whereby flowing refrigerant is sequentially particulate filtered and noise muffled, regardless of the orientation of said valve within the refrigerant line.

3. For use in a refrigerant line in an automotive air conditioning system in which the refrigerant carries particulate type contaminants, a bi directional refrigerant expansion valve with combined inlet particulate filter and valve outlet noise attenuation features, comprising:

a central, cylindrical orifice tube to receive and contract high pressure refrigerant inlet flow and expand it into a low pressure outlet flow, thereby creating expansion noise;

a substantially rigid central plug body adapted to be installed tightly sealed within the interior of said refrigerant line and also tightly sealed around the outside of said orifice tube with each end of said tube extending axially therefrom by the same distance, so that either end of said tube can provide an inlet and the other end an outlet, a pair of substantially rigid, open exterior support frames sized to fit within said refrigerant line, one abutted to each end of said plug and extending axially beyond and surrounding each end of said orifice tube, an outer particulate screen having a mesh just sufficiently small to exclude substantially all refrigerant particulates and closely contained within each support frame and also having a closed outer end and an inner end effectively sealed to an end of said plug body, so that refrigerant must pass through a particulate screen before entering either end of the orifice tube, thereby excluding particulates, a pair of substantially rigid, open inner support frames sized to fit coaxially within said particulate screens, one surrounding each end of said orifice tube with an inner radial space between said inner frame and orifice tube and outer radial space between said inner frame and outer particulate screen, each of said inner frames also having an annular end ring substantially abutted with an end of said plug, said end ring having at least one by pass flow port interconnecting said inner and outer radial spaces and located proximate to an end of said plug end and axially spaced from an end of said orifice tube, an inner noise filter closely contained within each of said inner support frames having a porosity sufficiently small and an axial length sufficiently large to substantially muffle said refrigerant expansion noise as said refrigeration outlet flow runs through it, and further having a closed outer end and an inner end effectively sealed to an annular end ring of said inner support frame, so that refrigerant exiting either end of said orifice tube will pass through the noise filter, unless the noise filter has been plugged sufficiently by smaller particulates that have passed the outer screen so as to force the refrigerant to flow axially in reverse and through the by pass port, whereby flowing refrigerant is sequentially particulate filtered and noise muffled, regardless of the orientation of said valve within the refrigerant line, with a potential by pass flow path available in the event of blockage of the downstream noise filter.

* * * * *